US011976856B2

(12) United States Patent
Inoue

(10) Patent No.: US 11,976,856 B2
(45) Date of Patent: May 7, 2024

(54) SHELL AND PLATE HEAT EXCHANGER FOR WATER-COOLED CHILLER AND WATER-COOLED CHILLER INCLUDING THE SAME

(71) Applicant: DAIKIN INDUSTRIES, LTD., Osaka (JP)

(72) Inventor: Satoshi Inoue, Plymouth, MN (US)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/206,537

(22) Filed: Mar. 19, 2021

(65) Prior Publication Data

US 2022/0299244 A1 Sep. 22, 2022

(51) Int. Cl.

| | |
|---|---|
| ***F25B 39/02*** | (2006.01) |
| ***F25B 39/04*** | (2006.01) |
| ***F28D 9/00*** | (2006.01) |
| ***F28F 3/04*** | (2006.01) |
| ***F28F 13/18*** | (2006.01) |

(52) U.S. Cl.

CPC ..... *F25B 39/022* (2013.01); *F25B 39/04* (2013.01); *F28F 3/048* (2013.01); *F28F 13/18* (2013.01); *F25B 2339/0241* (2013.01); *F25B 2339/046* (2013.01); *F28D 9/0043* (2013.01); *F28F 2260/00* (2013.01)

(58) Field of Classification Search

CPC ..... F25B 39/022; F25B 39/04; F25B 2339/0241; F25B 2339/046; F28D 9/0037; F28D 9/0043; F28D 9/04; F28F 3/04; F28F 13/14; F28F 13/18; F28F 13/182; F28F 13/185; F28F 13/187; F28F 3/048

See application file for complete search history.

(56) References Cited

U.S. PATENT DOCUMENTS 1,170,902 A * 2/1916 Harrison ..... F28D 9/0037 165/DIG. 361
1,325,637 A * 12/1919 Harrison ..... F28F 3/083 165/DIG. 361

(Continued)

FOREIGN PATENT DOCUMENTS

CN 1172525 A 2/1998
DE 102007027316 B3 * 1/2009 ..... F28D 9/0012

(Continued)

OTHER PUBLICATIONS

Written Opinion for the corresponding international application No. PCT/US2022/010735, dated Jun. 20, 2022.

(Continued)

*Primary Examiner* — Eric S Ruppert
*Assistant Examiner* — Hans R Weiland
(74) *Attorney, Agent, or Firm* — Global IP Counselors, LLP

(57) ABSTRACT

A shell and plate heat exchanger includes a shell and a plate pack. The shell defines a cavity configured to receive a first fluid and a second fluid. The plate pack is arranged inside the cavity. The plate pack has a plurality of heat exchanger plates. Each of the heat exchanger plates has two sides facing in opposite directions in a thickness direction of the heat exchanger plate. At least one of the sides of at least one of the heat exchanger plates has a surface roughness of between 5 μm and 100 μm.

16 Claims, 8 Drawing Sheets

(56) References Cited

U.S. PATENT DOCUMENTS 2,251,066 A * 7/1941 Persson ..... F28F 3/025 165/DIG. 361
4,535,840 A * 8/1985 Rosman ..... F28D 9/0018 165/DIG. 357
5,179,999 A * 1/1993 Meekins ..... F28D 9/0012 165/41
5,839,295 A * 11/1998 Lehmann ..... F25B 39/022 62/295
5,875,838 A * 3/1999 Haselden ..... F28D 9/0043 165/146
6,085,832 A * 7/2000 Rehberg ..... F28F 3/042 165/167
6,199,626 B1 * 3/2001 Wu ..... F28D 9/0056 165/166
6,644,388 B1 * 11/2003 Kilmer ..... F28F 13/02 165/109.1
6,679,076 B1 * 1/2004 Duga ..... F25B 49/025 62/228.1
10,234,212 B2 * 3/2019 Noel-Baron ..... F28D 9/0043
2005/0039896 A1 * 2/2005 Laine ..... F28D 9/0043 165/157
2014/0202677 A1 * 7/2014 Fujii ..... F28F 13/12 165/185
2015/0027678 A1 1/2015 Song et al.
2015/0114817 A1 * 4/2015 Kontu ..... F28D 9/0043 202/180
2017/0254596 A1 * 9/2017 Noel-Baron ..... F28D 9/0012
2019/0233336 A1 * 8/2019 Landtiser ..... F28D 9/0043

FOREIGN PATENT DOCUMENTS

EP 2 565 575 B1 12/2017
EP 3 637 022 A1 4/2020
GB 1328941 A * 9/1972 ..... F28D 9/04
JP 8-218151 A 8/1996

OTHER PUBLICATIONS

International Search Report for the corresponding international application No. PCT/US2022/010735, dated Jun. 20, 2022.

* cited by examiner

SHELL AND PLATE HEAT EXCHANGER FOR WATER-COOLED CHILLER AND WATER-COOLED CHILLER INCLUDING THE SAME

BACKGROUND

Field of the Invention

The present invention generally relates to a shell and plate heat exchanger for a water-cooled chiller and a water-cooled chiller including the shell and plate heat exchanger. More specifically, the present invention relates to shell and plate heat exchanger having a heat transfer coefficient suitable for use in a water-cooled chiller.

Background Information

A chiller system is a refrigerating machine or apparatus that removes heat from a medium. Commonly, a liquid such as water or a liquid that contains water is used as the medium, and the chiller system operates in a vapor-compression refrigeration cycle to cool the liquid. The liquid can then be circulated through a heat exchanger to cool air or equipment as required. A necessary byproduct of the refrigeration cycle is waste heat, which must be exhausted from the refrigerant to the ambient air or, for greater efficiency, recovered for heating purposes. A vapor-compression type chiller system includes a compressor for compressing the refrigerant. Types of compressors used in vapor-compression chiller systems include reciprocating compressors, scroll compressors, screw compressors, and centrifugal compressors.

In a conventional (turbo) chiller, refrigerant is compressed in the compressor and sent to a heat exchanger in which heat exchange occurs between the refrigerant and a first heat exchange medium (e.g., a liquid). This heat exchanger is referred to as a condenser because the refrigerant condenses in this heat exchanger. As a result, heat is transferred to the first heat exchange medium (liquid) so that the first heat exchange medium is heated. Refrigerant exiting the condenser is expanded by an expansion valve and sent to another heat exchanger in which heat exchange occurs between the refrigerant and a second heat exchange medium (e.g., a liquid). This heat exchanger is referred to as an evaporator because refrigerant is evaporated in this heat exchanger. Heat is transferred from the second heat exchange medium (e.g., water, as mentioned above) to the refrigerant, and the liquid is chilled. The refrigerant from the evaporator is then returned to the compressor and the cycle is repeated.

The heat exchangers used as the condenser and the evaporator in water-cooled chillers are typically shell and tube type heat exchangers (including flooded and falling film type heat exchangers). That is, the heat exchanger includes an outer shell defining a cavity or chamber and a plurality of tubes arranged inside the cavity. In this type of heat exchanger, generally, the refrigerant is passed through the cavity and the liquid medium (i.e., the first heat exchange medium or the second heat exchange medium) is passed through the insides of the tubes. Another type of heat exchanger that can be used as the condenser or the evaporator is a shell and plate type heat exchanger. Shell and plate heat exchangers tend to be slightly more expensive to manufacture than shell and tube heat exchangers. However, shell and plate heat exchangers can potentially be made to have a smaller footprint and occupy less space than shell and tube heat exchangers. Shell and plate heat exchangers can also be operated with a smaller amount of refrigerant. Thus, there are advantages that can be obtained by using a shell and plate heat exchanger instead of a shell and tube heat exchanger.

SUMMARY

Although there are advantages to shell and plate heat exchangers as mentioned above, it has been challenging to achieve a sufficient heat transfer coefficient at the surfaces of the plates of a shell and plate heat exchanger to be suitable for water-cooled chiller applications. Improvements of up to three times currently available heat transfer coefficients are desirable to make shell and plate heat exchangers practical for use as condensers and evaporators in water-cooled chiller applications.

Some embodiments of the present application provide a shell and plate heat exchanger having an improved heat transfer coefficient such that the shell and plate heat exchanger is suitable for use as a condenser or an evaporator in a water-cooled chiller system. Some embodiments provide a water-cooled chiller utilizing the shell and plate heat exchanger as at least one of the condenser or the evaporator.

In view of the state of the known technology, one aspect of the present disclosure is to provide a shell and plate heat exchanger adapted to be used in a water-cooled chiller. The shell and plate heat exchanger includes a shell and a plate pack. The shell defines a cavity configured to receive a first fluid and a second fluid. The plate pack is arranged inside the cavity. The plate pack has a plurality of heat exchanger plates. Each of the heat exchanger plates has two sides facing in opposite directions in a thickness direction of the heat exchanger plate, and at least one of the sides of at least one of the heat exchanger plates has a surface roughness of between 5 μm and 100 μm or a plurality of grooves.

Some embodiments of the present disclosure provide a water-cooled chiller employing a shell and plate heat exchanger. The water-cooled chiller includes a water line, an evaporator, and a condenser. The water line is arranged in thermal communication with an outside environment. The evaporator is a first shell and plate heat exchanger having a plurality of first heat exchanger plates. Each of the first heat exchanger plates has two sides facing in opposite directions in a thickness direction of the first heat exchanger plate. A surface roughness of at least one of the sides of at least one of the first heat exchanger plates is between 5 μm and 100 μm. The condenser is a second shell and plate heat exchanger having a plurality of second heat exchanger plates. Each of the second heat exchanger plates has two sides facing in opposite directions in a thickness direction of the second heat exchanger plate, and at least one of the sides of at least one of the second heat exchanger plates contains s-grooves or r-grooves.

These and other objects, features, aspects, and advantages of the present invention will become apparent to those skilled in the art from the following detailed description, which, taken in conjunction with the annexed drawings, discloses preferred embodiments.

BRIEF DESCRIPTION OF THE DRAWINGS

The drawings which form a part of this original disclosure will now be briefly described.

DETAILED DESCRIPTION OF EMBODIMENT(S)

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
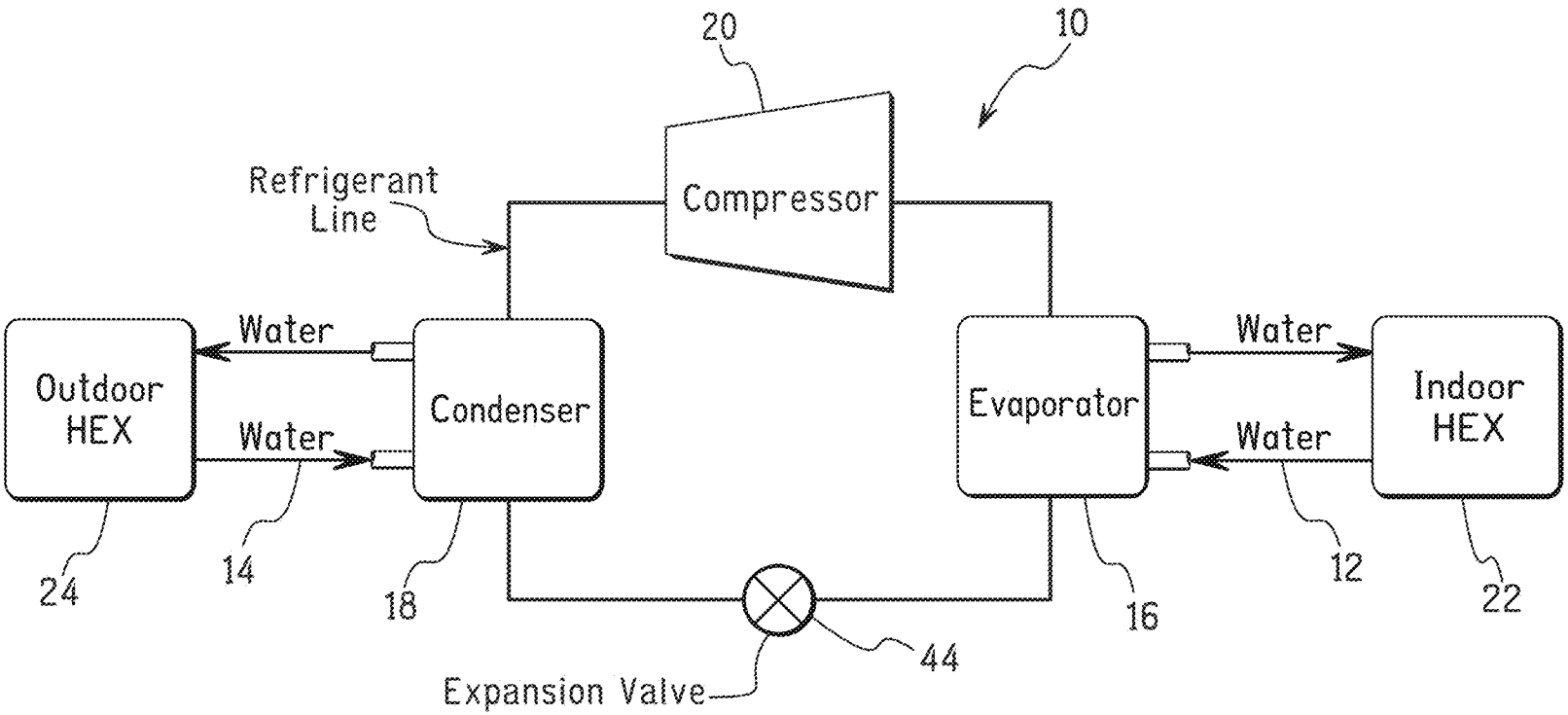
FIG. 1 illustrates a schematic view of a water-cooled chiller in accordance with an embodiment of the present invention.

FIG. 1 illustrates a water-cooled chiller 10 in accordance with an exemplary embodiment of the present invention. The water-cooled chiller 10 includes a first water line 12, a second water line 14, an evaporator 16, a condenser 18, and a compressor 20. The first water line 12 and the second water line 14 are each arranged in thermal communication with environments external to the chiller 10. In this embodiment, the first water line 12 is connected in thermal communication with a space to be cooled via an indoor heat exchanger 22 (e.g., a fan coil unit). Meanwhile, the second water line 14 is in thermal communication with an outdoor atmosphere via an outdoor heat exchanger 24 (e.g., a cooling tower). In this embodiment, the compressor 20 is a centrifugal compressor, but the invention is not limited to a chiller having a centrifugal compressor.

The evaporator 16 is a first shell and plate heat exchanger having a plurality of first heat exchanger plates 26. Each of the first heat exchanger plates 26 has two sides 26*a* and 26*b* facing in opposite directions in a thickness direction of the first heat exchanger plate 26. A surface roughness of at least one of the sides of at least one of the first heat exchanger plates is between approximately 5μ and 100 μm. The evaporator 16 will be explained in more detail later.

Figure 11:
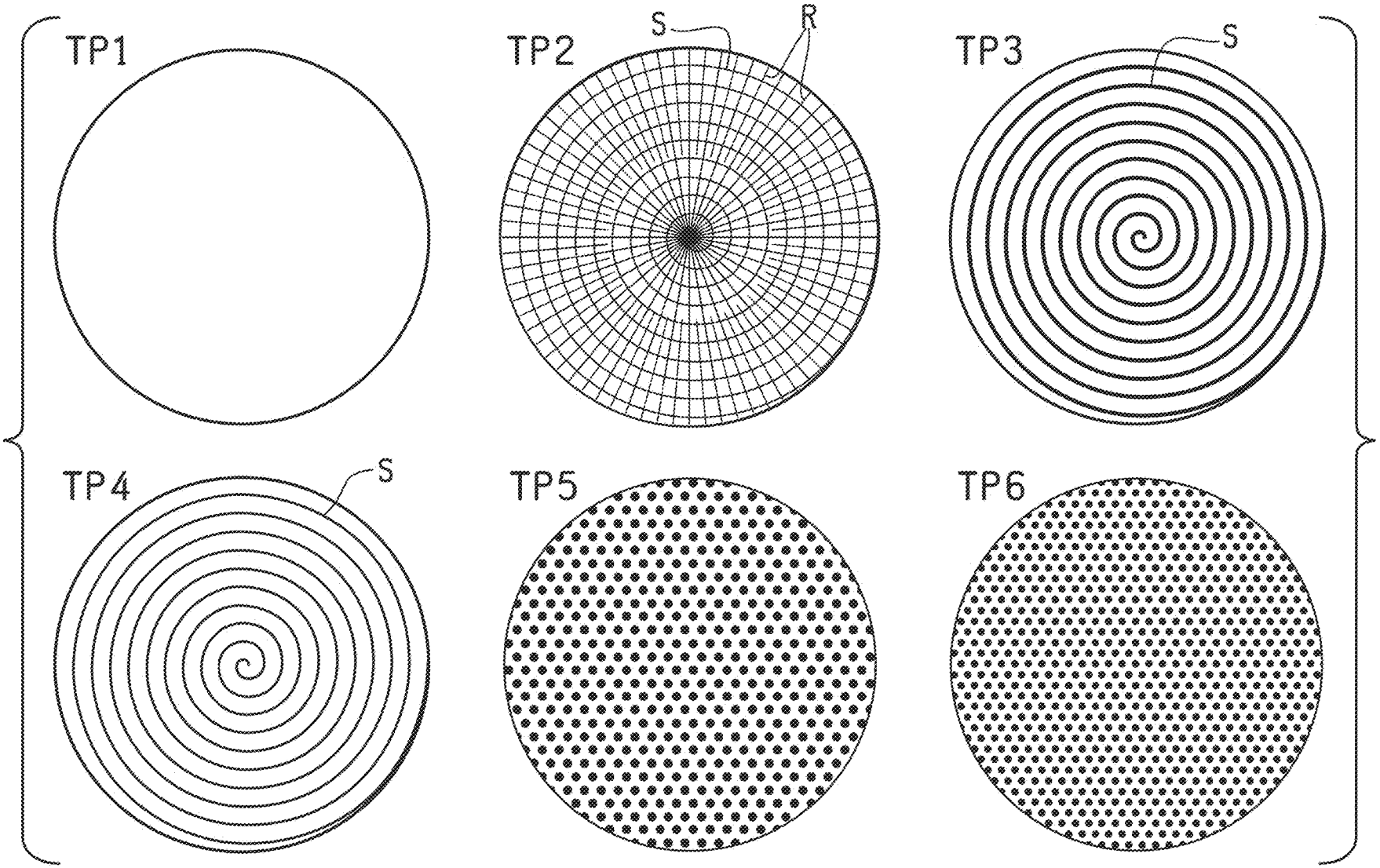
FIG. 11 is a diagrammatic view illustrating the surface configurations of six test plates used to test heat transfer performance.

The condenser 18 is a second shell and plate heat exchanger having a plurality of second heat exchanger plates 28. Each of the second heat exchanger plates 28 has two sides 28*a* and 28*b* facing in opposite directions in a thickness direction of the second heat exchanger plate 28. In some embodiments, at least one of the sides of at least one of the second heat exchanger plates 28 contains s-grooves S or r-grooves R. As shown in FIG. 11, in some embodiments, an s-groove is a spiral groove that emanates from the center of the heat exchanger plate, and an r-groove is a radial groove that emanates from the center of the plate. In some embodiments, the grooves may be concentric circles, or other shapes, or similar groove patterns. The condenser 18 will be explained in more detail later.

In some embodiments, the water-cooled chiller 10 has a capacity of at least 300 tons of refrigeration. Thus, the water-cooled chiller 10 is particularly well suited for medium to large industrial applications. However, the present invention is not limited to such applications. In particular, the features of the evaporator and the condenser can be used in smaller sized chillers or in other heat exchanger applications in which a shell and plate heat exchanger with enhanced heat transfer performance is required.

Figure 2:
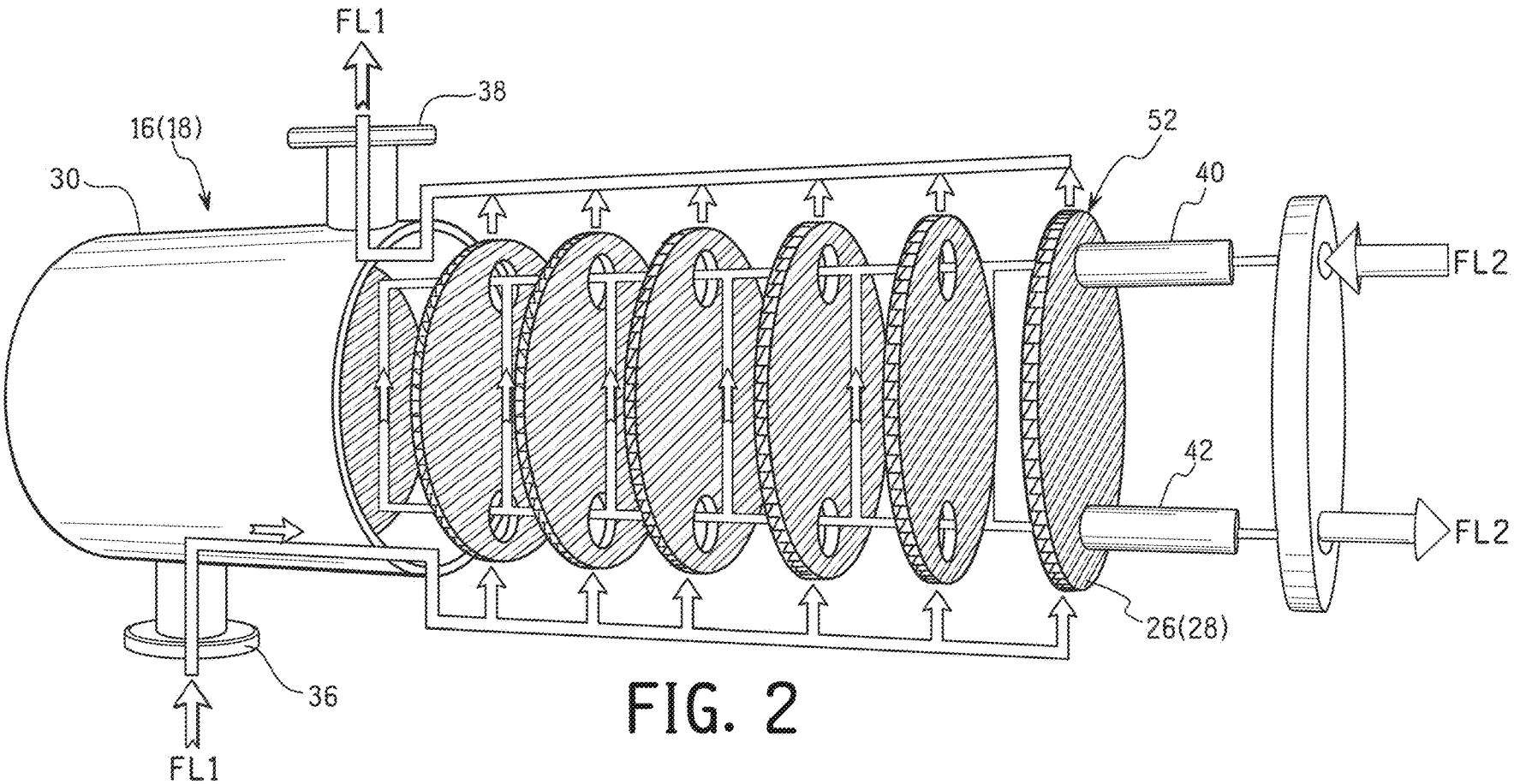
FIG. 2 is a perspective exploded view illustrating a shell and plate heat exchanger in accordance with an embodiment of the present invention.
Figure 4:
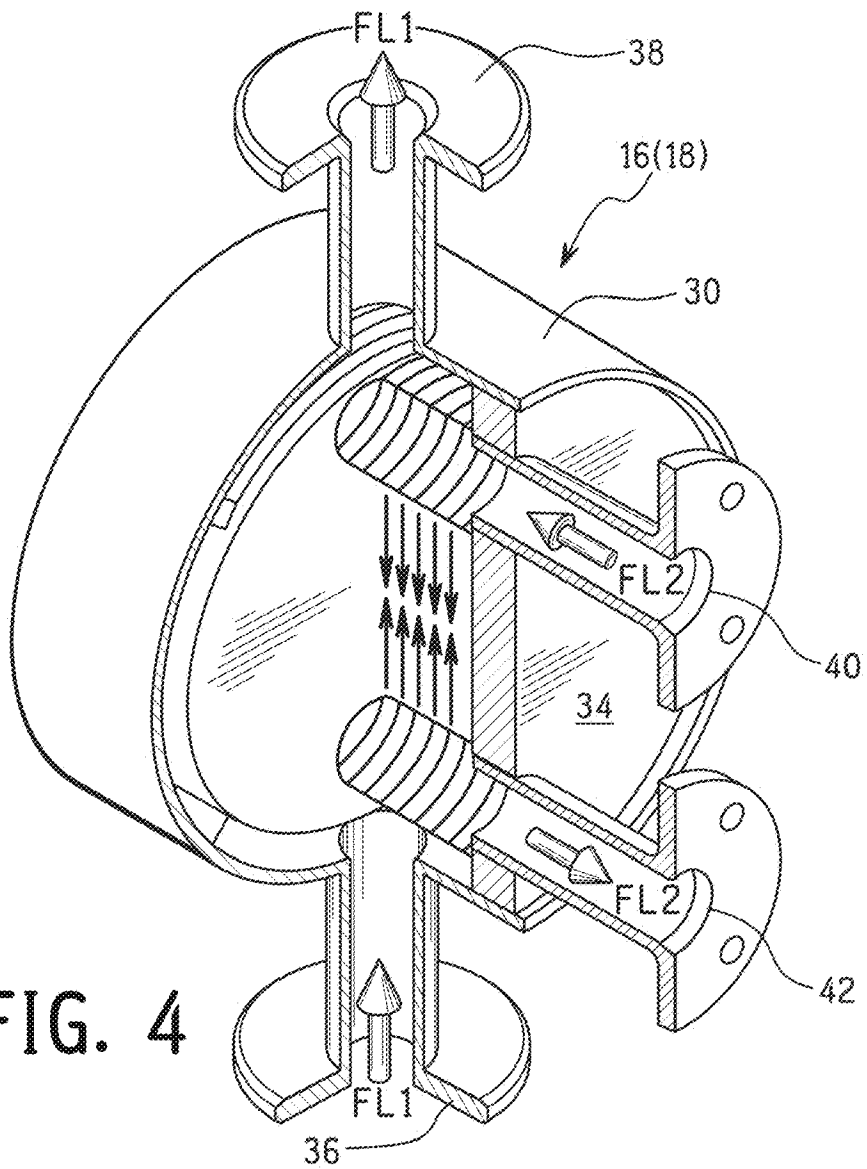
FIG. 4 is a partially sectioned perspective view of an embodiment of a shell and plate heat exchanger.
Figure 3:
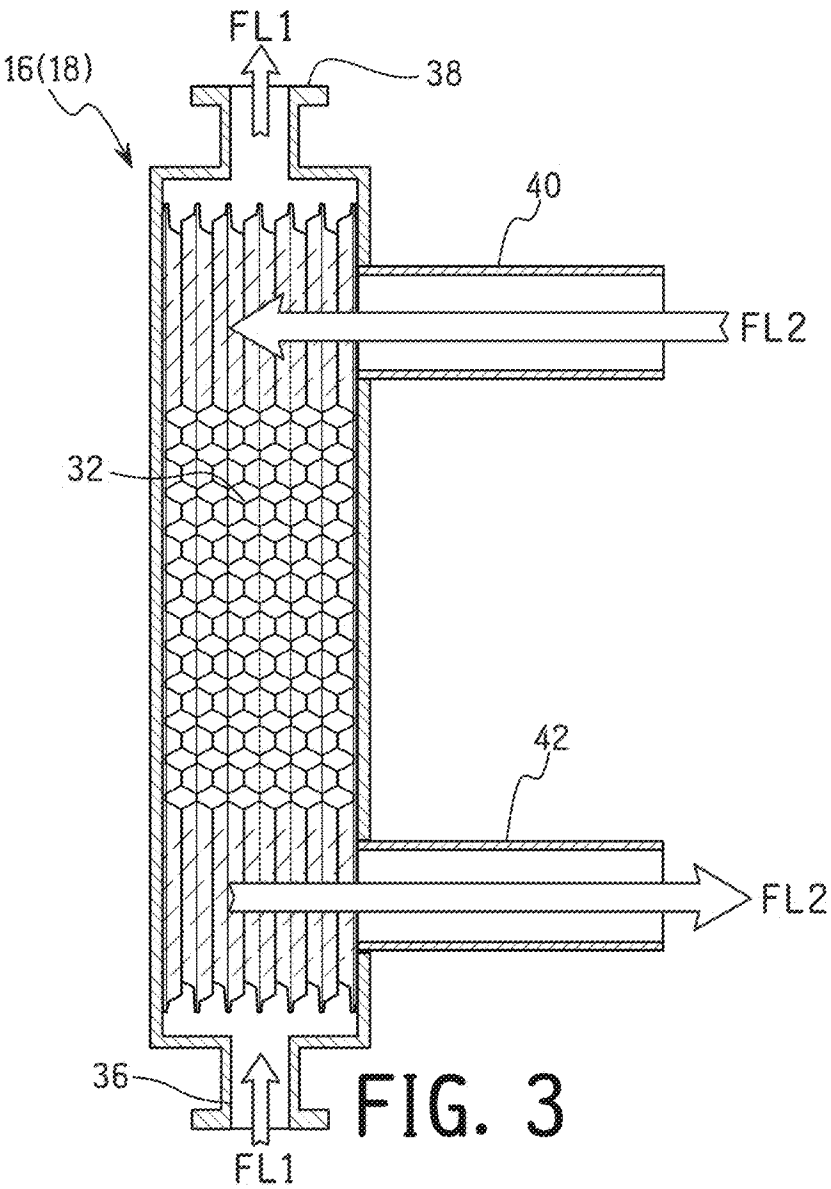
FIG. 3 is a longitudinal cross-sectional view of an embodiment of a shell and plate heat exchanger.

FIGS. 2-4 illustrate the evaporator 16, which exemplifies a shell and plate heat exchanger in accordance with an exemplary embodiment of the present invention. The evaporator 16 includes a shell 30 and a plate pack 32. The shell 30 defines a cavity 34 configured to receive a first fluid FL1 and a second fluid FL2. More specifically, the shell 30 includes a first inlet port 36 for receiving the first fluid FL1 and a first outlet port 38 for discharging the first fluid FL1. The shell 30 also includes a second inlet port 40 for receiving the second fluid FL2 and a second outlet port 42 for discharging the second fluid FL2. In this embodiment, the first fluid FL1 is a refrigerant and the second fluid FL2 is a liquid containing water that flows in the first water line 12. In some embodiments, the refrigerant could be any number of refrigerants, including, without limitation, R1233zd(E), R410A, R32, R454B, DR-55, R134A, R513A, R515A, R515B, HFO refrigerants such as HFO-1234ze, HFO-1233zd, or HFO-1234yf, or any number of combinations thereof. As shown in FIG. 1, the first fluid FL1 (refrigerant) circulates in a refrigeration circuit made up of the evaporator 16, the condenser 18, the compressor 20, and an expansion valve 44. The second fluid FL2 (liquid) flows through the first water line 12 between the evaporator 16 and the indoor heat exchanger 22 (e.g., a fan coil unit). The first inlet port 36 and the first outlet port 38 are connected to the refrigeration circuit, and the second inlet port 40 and the second outlet port 42 are connected to the first water line 12.

Figure 6:
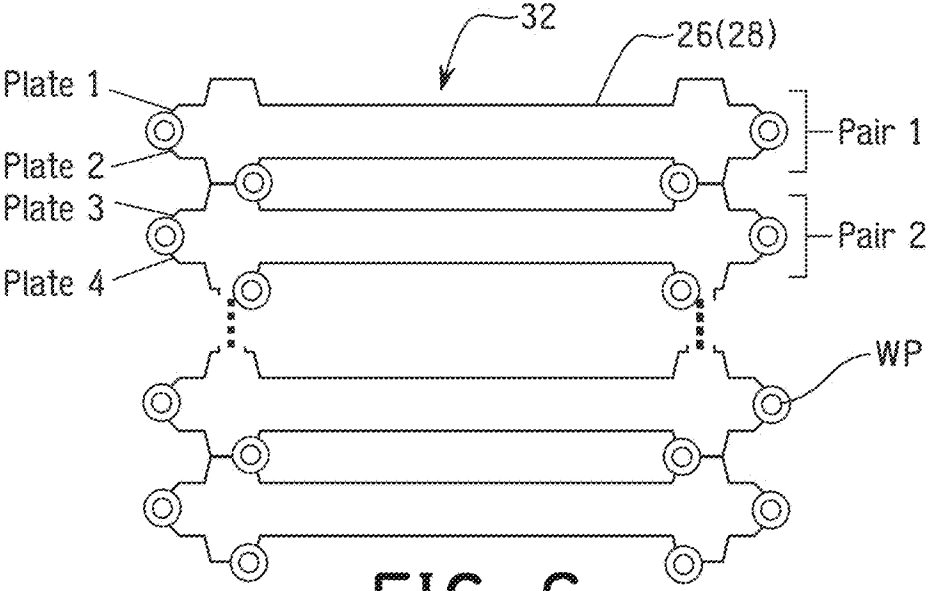
FIG. 6 is a schematic view illustrating the welded structure of the plate pack of an embodiment of a shell and plate heat exchanger.
Figure 5:
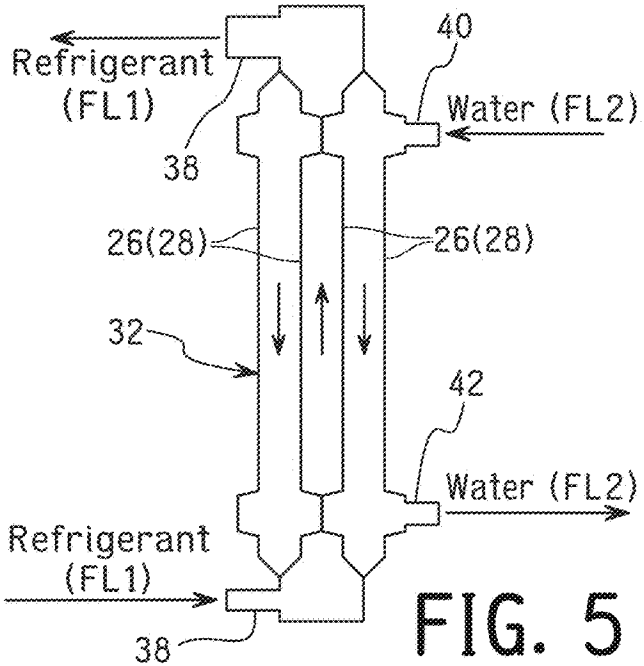
FIG. 5 is a diagrammatic view illustrating a crossflow pattern in an embodiment of a shell and plate heat exchanger.

The plate pack 32 is arranged inside the cavity 34. The plate pack 32 is made up of the plurality of first heat exchanger plates 26. Each of the first heat exchanger plates 26 has two sides 26*a* and 26*b* facing in opposite directions in a thickness direction of the heat exchanger plate 26. As illustrated in FIG. 5, the plate pack 32 is arranged and configured such that the first fluid FL1 (refrigerant) and the second fluid FL2 (liquid) flow through alternating spaces between the first heat exchanger plates 26. That is, the first heat exchanger plates 26 of the plate pack 32 are arranged and configured to define flow passages such that the refrigerant will flow through a space between two adjacent plates 26 in the plate pack 32 as the refrigerant flows from the first inlet port 36 to the first outlet port 38. The first heat exchanger plates 26 are further configured and arranged to define flow passages such that the liquid will flow through a different space between two adjacent plates 26 in the plate pack 32 as the liquid flows from the second inlet port 40 to the second outlet port 42. In this exemplary embodiment, the refrigerant and liquid will be separated by a thermally conductive heat exchanger plate. In other words, except for the two first heat exchanger plates 26 disposed at opposite ends of the evaporator 16, one of the sides, either 26*a* or 26*b* of each of the first heat exchanger plates 26 comes into contact with the refrigerant and the opposite side of each of the first heat exchanger plates 26 comes into contact with the liquid. In some embodiments, the flow passages are defined in part by welding the first heat exchanger plates 26 at welding points WP as best illustrated in FIG. 6. However, the present invention is not limited to using welds to seal adjacent plates. For example, gaskets or another sealing method may be used.

Figure 7:
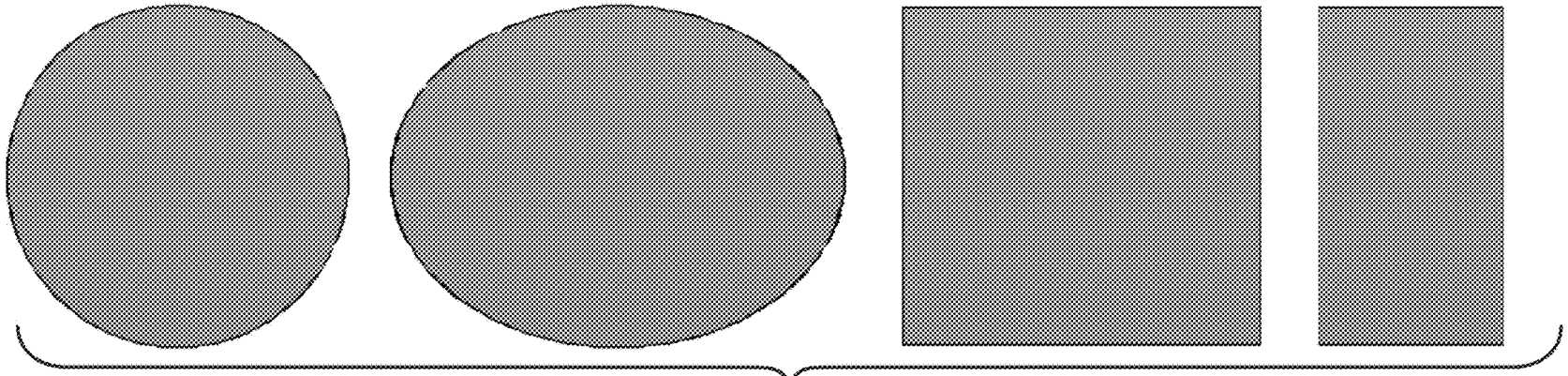
FIG. 7 is a diagram illustrating potential shapes of the heat exchanger plates of an embodiment of a shell and plate heat exchanger.

In some embodiments, the first heat exchanger plates 26 are substantially circular in shape. However, the shape of the heat exchanger plates is not particularly limited and may be oval, square, or rectangular, as shown in FIG. 7, in accordance with the shape of the shell 30. The first heat exchanger plates 26 of the evaporator 16 are arranged inside the cavity 34 of the shell 30 such that the first heat exchanger plates 26 are parallel to one another with a prescribed spacing in-between. In some embodiments, the first heat exchanger plates 26 are oriented vertically, however, a shell and plate heat exchanger according to the present invention is not limited to an arrangement in which the heat exchanger plates are oriented vertically.

In some embodiments, as shown in FIGS. 3-5, the first inlet port 36 is located at the bottom of the shell 30 and the first outlet port 38 is located at the top of the shell 30 in the installed state of the evaporator 16. Thus, the first fluid FL1 (refrigerant) moves from the bottom of the cavity 34 to the top of the cavity 34 as it travels from the first inlet port 36 to the first outlet port 38. Meanwhile, the second inlet port 40 is near the top of the shell 30 and the second outlet port 42 is located near the bottom of the shell 30. Thus, the second fluid FL2 (liquid) moves from the top of the cavity 34 to the bottom of the cavity 34 as it travels from the second inlet port 40 to the second outlet port 42. Accordingly, as best shown in FIG. 4, the evaporator 16 is operated in a counterflow mode in this embodiment. However, the present invention is not limited to a counterflow arrangement.

In some embodiments, the first heat exchanger plates 26 are made of stainless steel for such advantageous properties as strength and corrosion resistance. However, the present invention is not limited to heat exchanger plates made of stainless steel. In some embodiments, the surface roughness is achieved using sandblasting. Alternatively, in some embodiments, the surface roughness is achieved using another surface modifying technique such as, for example, etching or nanoparticle spraying.

In some embodiments, the condenser 18 has essentially the same configuration as the evaporator 16. Therefore, for the sake of clarity, the same reference numerals will be used for corresponding parts. Specifically, as shown in FIGS. 2-5, the condenser 18 includes a shell 30 and a plate pack 32. The shell 30 defines a cavity 34 configured to receive a first fluid FL1 and a second fluid FL2. More specifically, the shell 30 includes a first inlet port 36 for receiving the first fluid FL1 and a first outlet port 38 for discharging the first fluid FL1. The shell 30 also includes a second inlet port 40 for receiving the second fluid FL2 and a second outlet port 42 for discharging the second fluid FL2. In this embodiment, the first fluid FL1 is the previously mentioned refrigerant and the second fluid FL2 is a liquid containing water that flows in the second water line 14 between the condenser 18 and the outdoor heat exchanger 24 (e.g., cooling tower). Thus, the first inlet port 36 and the first outlet port 38 are connected to the refrigeration circuit, and the second inlet port 40 and the second outlet port 42 of the condenser 18 are connected to the second water line 14.

Like the first heat exchanger plates 26 of the evaporator 16, the second heat exchanger plates 28 of the condenser are made of stainless steel, but the present invention is not limited to using stainless steel as the material of the second heat exchanger plates 28. In some embodiments, the grooves, s-grooves (spiral grooves) S and/or the r-grooves (radiate grooves) R are formed using a cutting tool. The cutting tool may have a tip angle of 30 degrees or 60 degrees, for example. However, the present invention is not particularly limited to forming the s-grooves and/or r-grooves using a cutting tool. In some embodiments, at least one of the sides of at least one of the second heat exchanger plates 28 contain both s-grooves and r-grooves. In some embodiments, one side of each of the second heat exchanger plates 28 is provided with s-grooves formed by a 30-degree cutting tool.

In some embodiments, the s-grooves of TP2, TP3, and TP4 are formed to a depth of approximately 500 μm with a pitch or spacing of approximately 500 μm. However, it is acceptable to use other depths and pitches. Preferably, the depth is in the range 100-1000 μm, and the pitch is in the range 100-1000 μm. In some embodiments, eighty of the r-grooves are formed at a depth of 25 μm and substantially equally spaced in the circumferential direction. However, it is acceptable to provide a different number of r-grooves formed to a different depth. Preferably, the number of r-grooves provided is in the range 60-100 and the depth of the r-grooves is in the range 10-50 μm.

Figure 9A:
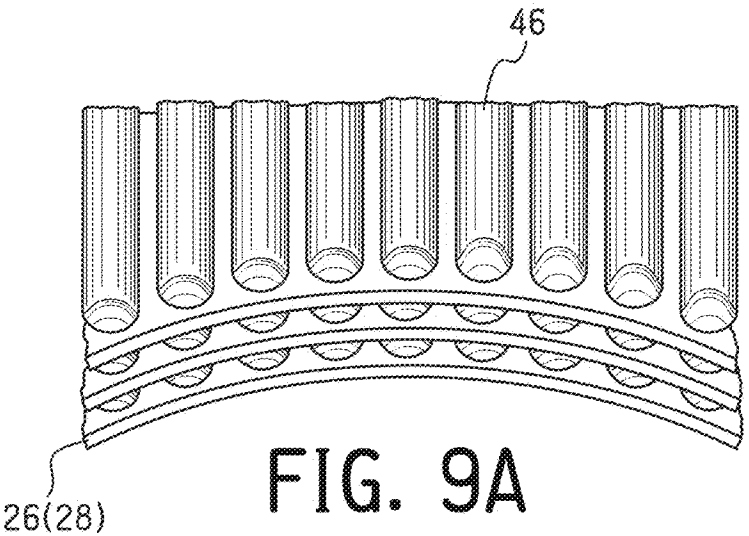
FIGS. 9A and 9B are partial views of the welded edges of port openings in adjacent cassettes of embodiments of a shell and plate heat exchanger.
Figure 9B:
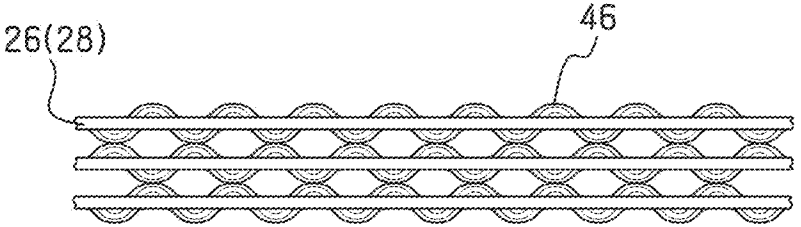
Figure 10B:
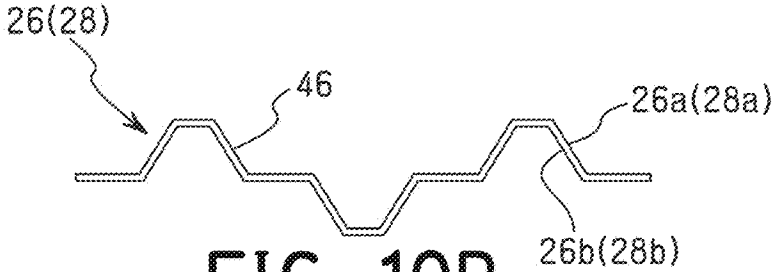
FIGS. 10A and 10B are diagrams illustrating potential cross-sectional shapes of the corrugations formed in the heat exchanger plates of an embodiment of a shell and plate heat exchanger.
Figure 8:
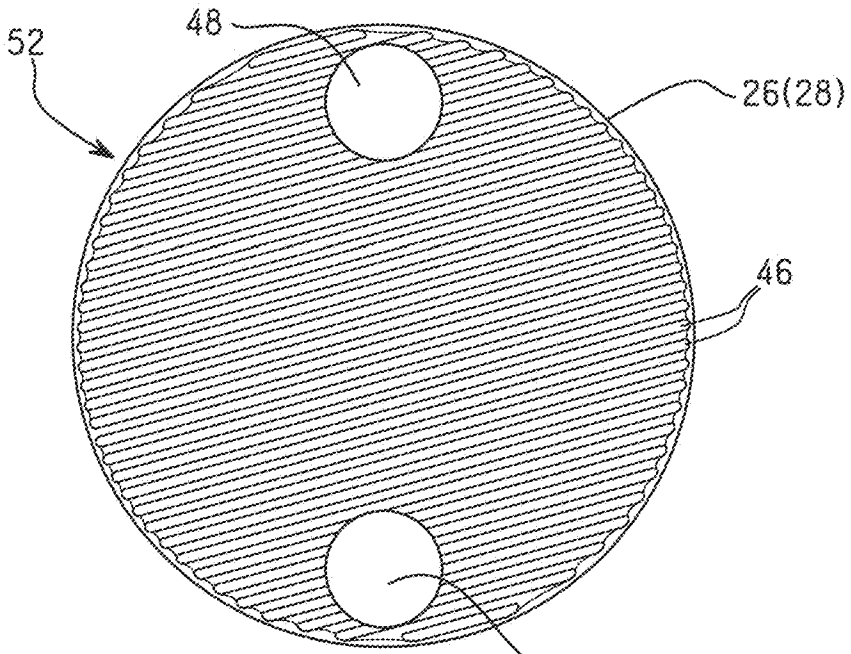
FIG. 8 is a side plan view of a pair of heat exchanger plates welded together to form a cassette of the plate stack of the shell and plate heat exchanger of FIG. 2.
Figure 10A:
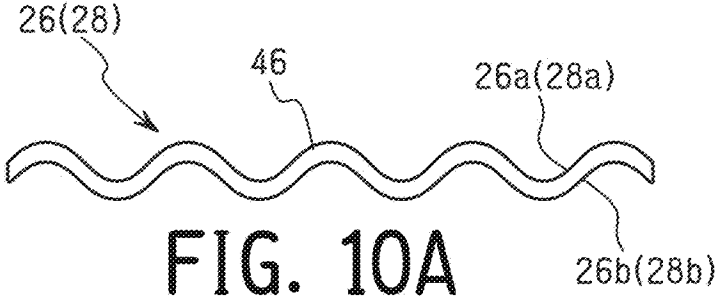

Referring to FIGS. 8-10, in some embodiments, in addition to the surface modifications (i.e., roughness or s-grooves and/or r-grooves), each of the first heat exchanger plates 26 and the second heat exchanger plates 28 is formed to have parallel corrugations or ridges 46 that span across the surface of the plate. These corrugations 46 serve to improve the rigidity of the plate. As shown in FIGS. 10A and 10B, the corrugations 46 may have a rounded cross-sectional shape or an angled cross-sectional shape. In some embodiments, each of the plates 26 and 28 is also provided with two openings 48 and 50 for establishing inlet and outlet passages within the plate pack 32. During construction, pairs of the plates may be joined together as cassettes 52 (see FIGS. 2, 6, and 8) such that the openings 48 and 50 are aligned with each other and the two plates are welded together with a weld formed around the circumference of the openings 48 and 50. The cassettes 52 are then welded together to form the plate pack 32. In some embodiments, the internal plate surfaces of the cassettes 52 are left plain (unmodified). FIGS. 9A and 9B depict the welded edges of one of the openings 48 or 50 formed in three adjacent cassettes 52. The openings 48 and 50 of the heat exchanger plates (first or second heat exchanger plates 26 or 28) are connected to the second inlet port 40 and the second outlet port 42, respectively, of the evaporator 16 or the condenser 18.

As mentioned previously, the surface of at least one of the sides 26*a* and 26*b* of at least one of the first heat exchanger plates 26 of the evaporator 16 has been modified to have a surface roughness of between 5 μm and 100 μm. As will be discussed in more detail later, the surface roughness may be between 5 μm and 100 μm and serves to increase a heat transfer coefficient between the fluid and the surface of the heat exchanger plate 26. Preferably, the surface roughness of the at least one side of the at least one heat exchanger plate 26 is equal to or greater than 5 μm and less than or equal to 50 μm. Still more preferably, the surface roughness of the at least one side of the at least one heat exchanger plate 26 is equal to or greater than 9 μm and less than or equal to 50 μm. Generally, the heat transfer performance improves with increased roughness. However, the thickness of each of the first heat exchanger plates 26 is generally between 0.3 mm to 0.5 mm (300-500 μm). Thus, achieving a roughness of over 100 μm involves removing a significant amount of material in comparison with the thickness of the first heat exchanger plates 26. In some cases, this may entail disadvantages such as increased cost and degraded structural integrity of the first heat exchanger plates 26.

Preferably, the surface modification is applied to all surfaces of the first heat exchanger plates 26 (or the second heat exchanger plates 28) where increased heat transfer performance is desired. Meanwhile, in some embodiments, it is acceptable to omit the surface modification on the surfaces of the heat exchanger plates 26 or 28 where improved heat transfer performance is not needed. In other words, the need to improve the heat transfer performance may vary depending on the particular application and the fluids passing through the shell and plate heat exchanger. Thus, it is possible to provide a first surface roughness on the surface of a first heat exchanger plate 26 that is arranged to contact the first fluid FL1 (refrigerant) during operation and provide a second surface roughness, different from the first surface roughness, on other side of the first heat exchanger plate 26 that is arranged to contact the second fluid FL2 (liquid). For example, the first surface roughness may be larger than the second surface roughness. Likewise, the first surface roughness and the second surface roughness can be provided, respectively, on the two sides of all the first heat exchanger plates 26. Preferably, the first surface roughness applied to at least one of the sides of the plurality of first heat exchanger plates 26 arranged to contact the refrigerant is between 5 μm and 100 μm. Still more preferably, the first surface roughness is at least 9 μm, and the second surface roughness is less than 9 μm. In this embodiment, a surface roughness of approximately 9 μm is applied to the side of each of the first heat exchanger plates 26 that contacts the refrigerant, and the surface of the sides of the first heat exchanger plates 26 that contact the liquid are plain. Here, "plain" means the surfaces are not modified and are comparatively smooth with a surface roughness smaller than 1 μm. Similarly, in this embodiment, the side of each of the second heat exchanger plates 28 that contacts the refrigerant is provided with s-grooves formed by a 30-degree cutter, and the other side of each of the second heat exchanger plates 28 is plain.

As will be explained in more detail, the inventors of the present application have found that improved heat transfer performance is achieved when the surfaces of sides of the first heat exchanger plates 26 of the evaporator 16 that contact the refrigerant are modified to have a surface roughness between 5 μm and 100 μm. By applying the surface roughness to the surfaces of the first heat exchanger plates 26 of the evaporator 16 that contact the refrigerant, it is possible to obtain a boiling heat transfer coefficient of 1.5 to 4.0 $kW/m^{2\cdot}$° C. when the shell and plate heat exchanger 10 is operated at a heat flux of 10 to 30 $kW/m^2$. More specifically, it is possible to obtain a boiling heat transfer coefficient of approximately 1.5 $kW/m^{2\cdot}$° C. at a heat flux of approximately 10 $kW/m^2$, and it is possible to obtain a boiling heat transfer coefficient of approximately 3.5 to 4.0 $kW/m^{2\cdot}$° C. at a heat flux of approximately 30 $kW/m^2$. Improved heat transfer performance was also achieved when the surfaces of sides of the second heat exchanger plates 28 of the condenser 18 that contact the refrigerant are modified to have a s-grooves formed with a 30-degree cutting tool.

The results of experimentation that led to the features of the illustrated embodiment described above will now be explained. As illustrated in FIG. 11, six test plates having six different surface configurations were prepared and used for testing heat transfer performance during both evaporation and condensation. The first test plate TP1 was had a plain, smooth surface with a roughness of 0.44 μm. The second test plate TP2 had a modified surface provided with both spiral grooves ("s-grooves") formed by a 60-degree cutter and radiate groove ("r-grooves). The third test plate TP3 had a modified surface provided with spiral grooves formed by a 60-degree cutter. The fourth test plate TP4 had a modified surface provided with spiral grooves formed by a 30-degree cutter. The fifth test plate TP5 had a modified surface provided with a roughness of 9.02 μm, and the sixth test plate TP6 had a modified surface provided with a roughness of 6.18 μm. The roughness values are based on the Ra roughness parameter. The roughened surfaces of TP5 and TP6 were formed by sandblasting. All the test plates had a thickness of 0.5 mm.

The testing involved evaluating the heat transfer coefficient HTC at the test surface of the test plate at heat flux values ranging from 0 to 30 $kW/m^2$ for both evaporation (boiling) and condensation of different test fluids. The test fluids included R1233zd(E) as a refrigerant and water as a liquid medium. The tests were conducted with the test plates in an open-face state as well as with a shield disposed in proximity to the surface of the test plate with a prescribed gap in-between to simulate the conditions inside a shell and plate heat exchanger. Extensive testing revealed that improved results for evaporation could be obtained by applying roughness to the surface that contacts the refrigerant. Meanwhile, it was found that improved results for condensation could be obtained by providing spiral grooves formed with a 30-degree cutting tool. It was found that surface modification was less important for the side of the heat exchanger plate that contacts the liquid medium (water) in the case of both evaporation and condensation.

Figure 12:
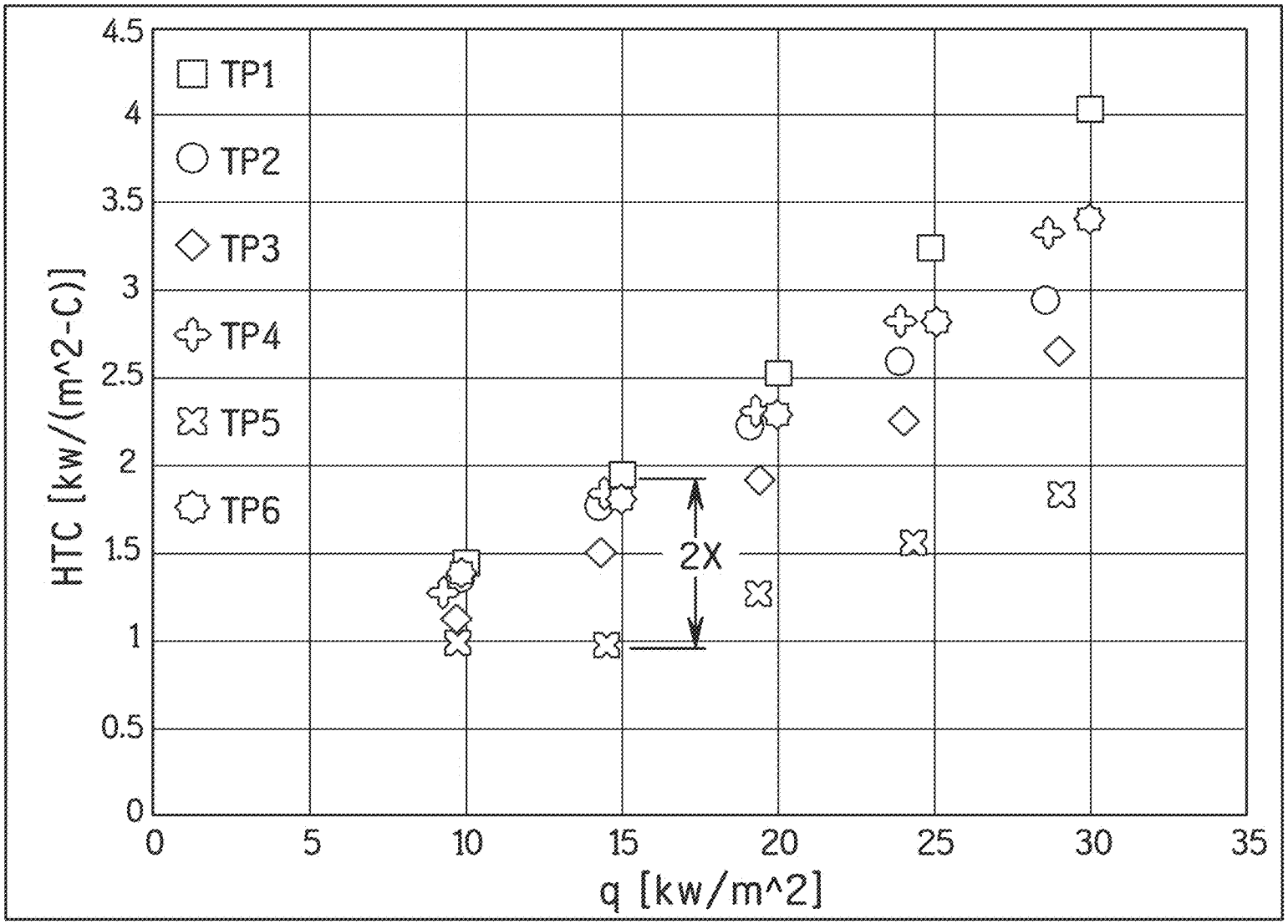
FIG. 12 is a plot of data obtained using the six test plates to test heat transfer performance during evaporation.
Figure 13:
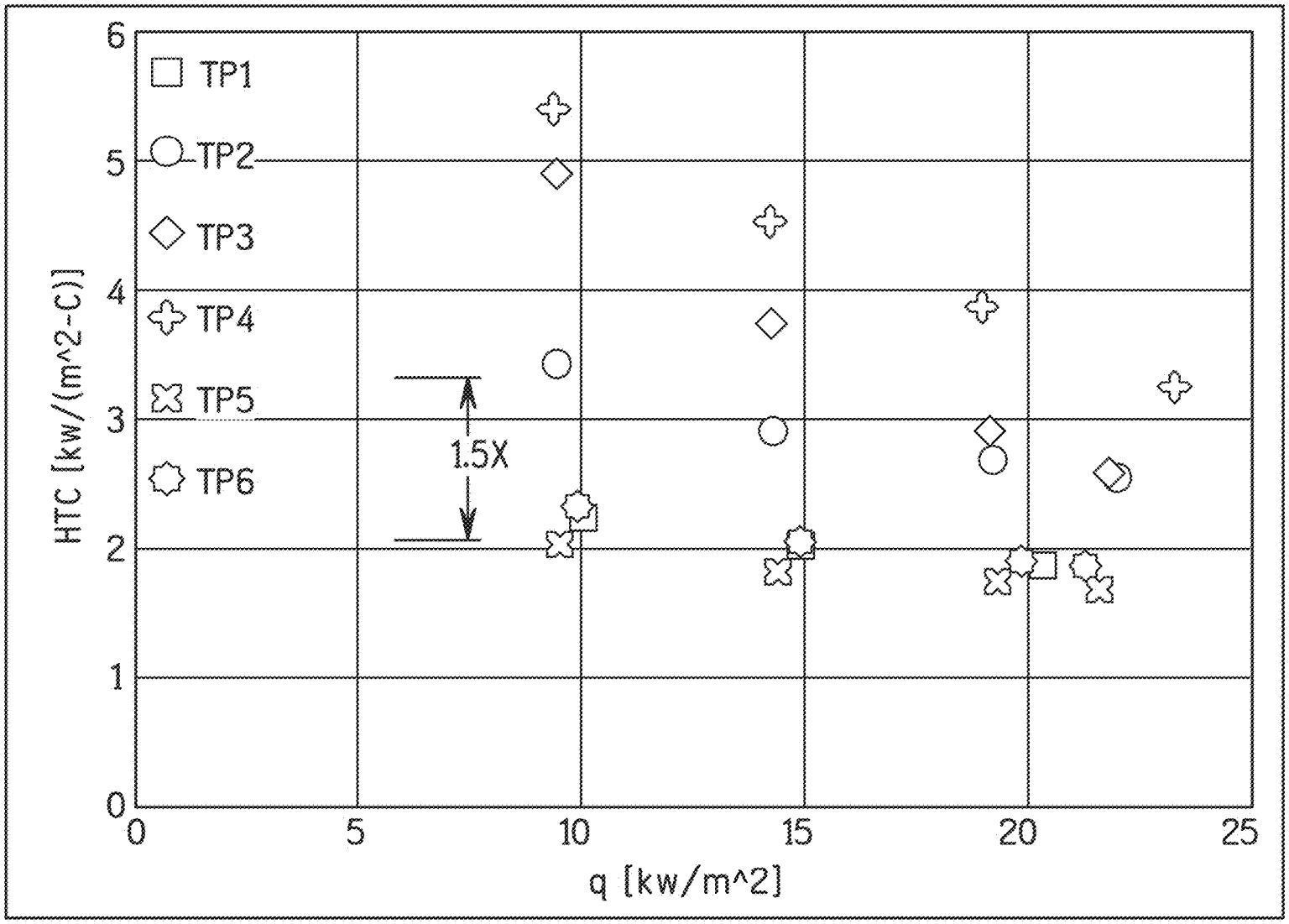
FIG. 13 is a plot of data obtained using the six test plates to test heat transfer performance during condensation.

FIGS. 12 and 13 summarize the test results for evaporation (boiling) and condensation, respectively. As shown in FIG. 12, for evaporation, the highest heat transfer coefficient was obtained with the test plate TP5, which was modified to have a roughness of 9.02 μm. Specifically, the boiling heat transfer coefficient ranged from approximately 1.5 to 4 $kW/m^2C°$ for heat fluxes ranging from 10 to 30 $kW/m^2$. Thus, the heat transfer coefficient obtained with TP5 is at least twice as large as the heat transfer coefficient obtained with the plain test plate TP1. The remaining test plates T2-T4 and T6 also showed improvement over the plate test plate TP1. Without being bound by theory, it is expected that even higher heat transfer coefficients may be obtainable with surface modifications providing higher roughness values than TP5. However, as mentioned above, forming higher roughness values incurs higher cost due to longer sandblasting times, consumption of more sandblasting sand, and/or more waste material being removed from the heat transfer plates.

As shown in FIG. 13, for condensation, the highest heat transfer coefficient was obtained with the test plate TP4, which had the spiral groove formed with a 30-degree cutter. Specifically, the boiling heat transfer coefficient ranged from approximately 5.4 to 3.2 $kW/m^2C°$ for heat fluxes ranging from 10 to 25 $kW/m^2$. Thus, the heat transfer coefficient obtained with TP4 is at least 1.5 times as large as the heat transfer coefficient obtained with the plain test plate TP1. The test plate TP3 also provided good results. Meanwhile, using surface roughness as the surface modification (TP5 and TP6) did not provide a significant improvement over the plain test plate TP1 in the case of condensation.

By utilizing surface roughness as the surface modification in the evaporator 16 and s-grooves (spiral grooves) as the surface modification in the condenser 18, the water-cooled chiller 10 according to the illustrated embodiment offers improved performance. In some embodiments, the water-cooled chiller 10 can provide the advantages of compact size and reduced refrigerant volume that can be obtained by using shell and plate heat exchangers instead of shell and tube heat exchangers as the evaporator and the condenser. At the same time, embodiments of the water-cooled chiller 10 do not sacrifice heat exchanger performance in order to enjoy these advantages. Although some embodiments describe an application in which one fluid is a refrigerant and the other fluid is a liquid containing water, a shell and plate heat exchanger according to the present invention is not particularly limited to this pairing of fluids. Moreover, a shell and plate heat exchanger in accordance with the present invention is not particularly limited to chiller applications and may be used as something other than an evaporator or a condenser.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A shell-and-plate heat exchanger comprising:

a shell defining a cavity configured to receive a first fluid and a second fluid; and a plate pack arranged inside the cavity, the plate pack having a plurality of heat exchanger plates, each of the heat exchanger plates having a first side and a second side facing in opposite directions in a thickness direction of the heat exchanger plate, the first side of each of the heat exchanger plates being arranged to contact the first fluid during operation and having a first surface roughness between 5 μm and 100 μm, the second side of each of the heat exchanger plates being arranged to contact the second fluid during operation and having a second surface roughness between 5 μm and 100 μm, and the first surface roughness being larger than the second surface roughness, and the first fluid being a refrigerant and the second fluid containing water.

2. The shell-and-plate heat exchanger according to claim 1, wherein the shell includes a first inlet port for receiving the first fluid and a first outlet port for discharging the first fluid, and a second inlet port for receiving the second fluid and a second outlet port for discharging the second fluid, and the plate pack is arranged and configured such that the first fluid and the second fluid flow through spaces between the heat exchanger plates.

3. The shell-and-plate heat exchanger according to claim 1, wherein the first surface roughness is equal to or greater than 5 μm and less than or equal to 50 μm.

4. The shell-and-plate heat exchanger according to claim 3, wherein the first surface roughness is equal to or greater than 9 μm and less than or equal to 50 μm.

5. The shell-and-plate heat exchanger according to claim 1, wherein the first surface roughness is at least 9 μm, and the second surface roughness is less than 9 μm.

6. The shell-and-plate heat exchanger according to claim 1, wherein a thickness of the heat exchanger plates is 0.3 mm to 0.5 mm.

7. A water-cooled chiller comprising:

a water line arranged in thermal communication with an outside environment;

an evaporator including a first shell-and-plate heat exchanger having a first shell and a plurality of first heat exchanger plates, the first shell defining a cavity configured to receive a first fluid and a second fluid, each of the first heat exchanger plates having a first side and a second side facing in opposite directions in a thickness direction of the first heat exchanger plate; and a condenser including a second shell-and-plate heat exchanger having a plurality of second heat exchanger plates, each of the second heat exchanger plates having two sides facing in opposite directions in a thickness direction of the second heat exchanger plate, at least one of the sides of at least one of the second heat exchanger plates containing both an s-groove and a plurality of r-grooves, the s-groove being a spiral groove that emanates from the center of the heat exchanger plate and the plurality of r-grooves being radial grooves that emanate from the center of the plate, the first side of each of the first heat exchanger plates being arranged to contact the first fluid during operation and having a first surface roughness between 5 μm and 100 μm, the second side of each of the first heat exchanger plates being arranged to contact the second fluid during operation and having a second surface roughness between 5 μm and 100 μm, and the first surface roughness being different from the second surface roughness.

8. The water-cooled chiller according to claim 7, wherein at least one of the first surface roughness and the second surface roughness is equal to or greater than 5 μm and less than or equal to 50 μm.

9. The water-cooled chiller according to claim 8, wherein the at least one of the first surface roughness and the second surface roughness is equal to or greater than 9 μm and equal to or less than 50 μm.

10. The water-cooled chiller according to claim 7, wherein the evaporator has a first inlet port for receiving a refrigerant as the first fluid, a first outlet port for discharging the refrigerant, a second inlet port for receiving water from the water line as the second fluid, and a second outlet port for discharging the water.

11. The water-cooled chiller according to claim 7, wherein the water-cooled chiller has a capacity of at least 300 tons of refrigeration.

12. The water-cooled chiller according to claim 7, wherein a thickness of at least one of the first heat exchanger plates is 0.3 mm to 0.5 mm; and a thickness of at least one of the second heat exchanger plates is 0.3 mm to 0.5 mm.

13. The water-cooled chiller according to claim 7, wherein the s-groove has a depth in a range of 100 μm to 1000 μm.

14. The water-cooled chiller according to claim 13, wherein the s-groove has a pitch in a range of 100 μm to 1000 μm.

15. The water-cooled chiller according to claim 7, wherein each of the plurality of r-grooves has a depth in a range of 10 μm to 50 μm.

16. The water-cooled chiller according to claim 15, wherein the plurality of r-grooves includes 60 to 100 r-grooves.

* * * * *